US005944958A

United States Patent [19]

Svanqvist

[11] Patent Number: 5,944,958

[45] Date of Patent: Aug. 31, 1999

[54] METHOD OF AND A DEVICE FOR ADJUSTING CREPING CONDITIONS

[75] Inventor: Tord O. S. Svanqvist, Karlstad, Sweden

[73] Assignee: Valmet-Karlstad AB, Karlstad, Sweden

[21] Appl. No.: 07/935,984

[22] Filed: Aug. 27, 1992

[30] Foreign Application Priority Data

Sep. 16, 1991 [SE] Sweden ..... 9102682

[51] Int. Cl.[6] ..... B31F 1/12

[52] U.S. Cl. ..... 162/281; 162/263; 364/471.02

[58] Field of Search ..... 162/111, 280, 162/281, 263, 198, 112; 364/471.02, 471.03; 73/159

[56] References Cited

U.S. PATENT DOCUMENTS

| | | | |
|---|---|---|---|
| 3,778,861 | 12/1973 | Goodnow . | |
| 4,919,756 | 4/1990 | Sawdai . | |
| 4,970,895 | 11/1990 | Houghton et al. | 73/159 |
| 4,978,861 | 12/1990 | Sabater et al. . | |
| 5,221,351 | 6/1993 | Esser et al. | 118/413 |

OTHER PUBLICATIONS

"Creping Characteristics Sensor" by Techpap of Gières Mayencin, France.

J.H. Sloan, "Yankee Dryer Coatings", *Tappi Journal*, Aug. 1991, pp. 123–126.

R. Engström, "First in the World with On–Line Thickness Measurement for Soft Tissue Machines" as translated from Svensk Papperstidning, No. 6 1987.

*Primary Examiner*—Brenda A. Lamb

*Attorney, Agent, or Firm*—Alston & Bird LLP

[57] ABSTRACT

To carefully control the creping conditions when creping off a paper web (1) by means of a doctor blade (5) from the cylinder surface (2) of a Yankee dryer (3), a first sensor (82;85) is provided for measuring on-machine a value of the caliper, the crepe macrostructure, or some other property of the just creped off paper web (1), the measured value is monitored continually, and, on detecting an undesirable change in the value caused by blade wear, the doctor blade (5) is pivoted substantially around its working edge (6) to increase an impact angle (A), formed at the working edge and affecting the monitored web property, to such an extent as to minimize or at least counteract the undesirable change. Preferably, the sensor (82;85) is connected to a programmable processor (90) for automatically controlling the pivoting of the doctor blade (5). A web tension sensor (94) suitably is provided for continually monitoring a coating on the cylinder surface (2) and may be connected to the programmable processor (90), which then is programmed to control the properties of the coating by adjusting the amounts of an adhesive agent and a release agent in a coating composition to be applied onto the cylinder surface (2).

10 Claims, 11 Drawing Sheets

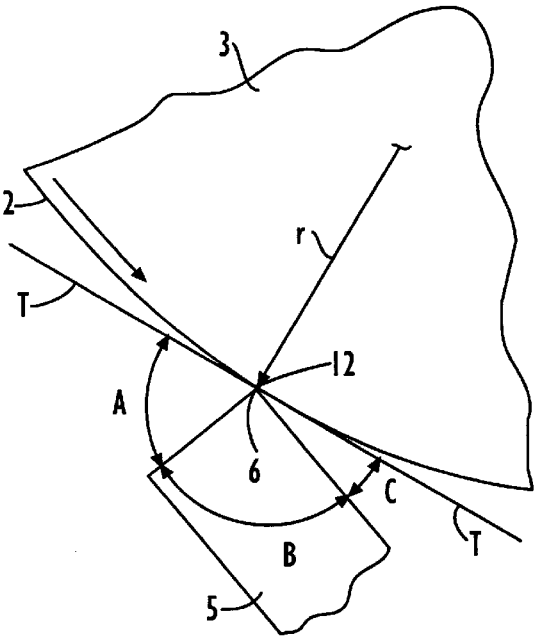
FIG. 12.
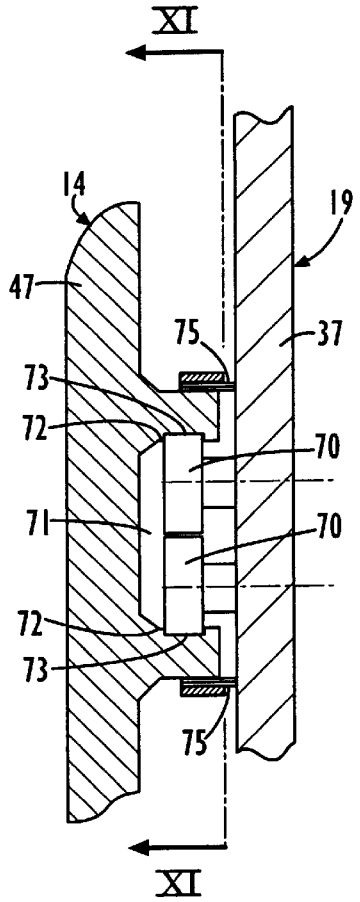
FIG. 10.
FIG. 11.
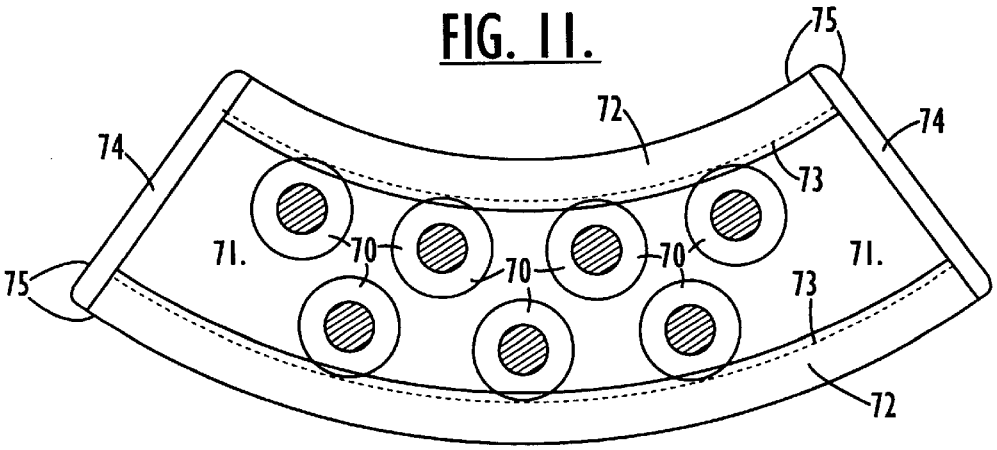

METHOD OF AND A DEVICE FOR ADJUSTING CREPING CONDITIONS

TECHNICAL FIELD

The present invention relates to a method of adjusting the creping conditions when creping off a paper web by means of a creping doctor from a movable creping surface, to which the paper web adheres, said creping doctor having an elongate doctor blade with a working edge and mounted in a bladeholder and extending across the width of the web, said creping doctor being mounted to be pivotable on a first rotational axis parallel to the blade and located at a distance from the creping surface to permit the blade to be pivoted to an active first position for creping off the web and an inactive second position, in which a worn blade may be removed from the bladeholder and a fresh blade inserted thereinto, and said bladeholder and blade being mounted to be pivotable around a second rotational axis parallel to the blade working edge and located for setting an arbitrary impact angle formed at the blade edge between the creping surface and an impact surface of the blade edge, said method including periodically monitoring a property of the creped off paper web, and pivoting the bladeholder and the doctor blade around the second rotational axis to increase the actual impact angle to such an extent as to substantially minimize or at least counteract a detected undesirable change in said property.

The invention also relates to a device for adjusting the creping conditions when creping off a paper web by means of a creping doctor from a movable creping surface to which the paper web adheres, said creping doctor having an elongate doctor blade with a working edge and mounted in a bladeholder and extending across the width of the web, said creping doctor being mounted to be pivotable on a first rotational axis parallel to the blade and located at a distance from the creping surface to permit the blade to be pivoted to an active first position for creping off the web and an inactive second position, in which a worn blade may be removed from the bladeholder and a fresh blade inserted thereinto, and said bladeholder and blade being mounted to be pivotable around a second rotational axis parallel to the blade working edge and located for setting an arbitrary impact angle formed at the blade edge between the creping surface and an impact surface of the blade edge.

BACKGROUND OF THE INVENTION

A method and device of the type described above are disclosed in U.S. Pat. No. 4,919,756 (Sawdai). The doctor blade is mounted in a bladeholder secured to a shaft extending parallel to the tip of the doctor blade. Each shaft end extends through a bearing in a two-armed impact-angle-adjust lever having one arm end pivotable in a pillow block located in alignment with the tip of the doctor blade. Axially outside the impact-angle-adjust lever a tipping lever is fixed to the shaft. An actuating cylinder is provided for swinging the tipping lever and, consequently, tipping the bladeholder between an active first position, in which the blade tip contacts the cylindrical surface of a Yankee dryer, and an inactive second position, in which a worn blade may be replaced. A jackscrew is connected between another pillow block and the other arm end of the impact-angle-adjust lever for pivoting the doctor blade around its tip. By continually adjusting the angular position of the doctor blade it is possible to reduce deleterious effects of doctor blade wear on the creping process by maintaining a substantially constant impact angle, and/or to substantially minimize the deleterious effects on a physical property of the paper web, e.g. the machine-direction tensile strength of the web, which would otherwise be caused by doctor blade wear.

The disclosed device has means for automatically continually adjusting the angular position of the doctor blade, and these adjusting means comprise means for being programmed with an empirically derived functional relation between the desired amount of doctor blade rotation and time. For deriving this functional relation it is necessary to average data over extended periods of time. Each application of the Sawdai invention is believed to require empirical development and iterative improvement of the best doctor blade control function for use in programming the doctor blade rotating mechanism. The operator, who monitors the operation of the papermaking machine and the doctor blade device, periodically checks the value of the product property of interest, e.g. the machine-direction tensile strength of the creped web. This is typically checked at the end of each roll of crepe paper as it is completed. Consequently, for each crepe paper grade manufactured there has to be a series of control curves (i.e. doctor blade rotation versus time after doctor blade change) to take different manufacturing conditions into account, such as machine speed, Yankee dryer surface coating, et cetera, and for each control curve it is necessary to average data over extended periods of time.

A parameter which has a great influence on the creping conditions is the properties of a coating developed or applied, e.g. by spraying, on the movable creping surface. Examples of such properties are adhesiveness and hardness/brittleness. In this context we also refer to Tappi Journal, August 1991, James H. Sloan, "Yankee dryer coatings", p. 123–126. A coating having high adhesiveness and low brittleness produces a low caliper, high density, fine creped web and high web tension in the run of the web from the movable creping surface to a subsequent reel. It also reduces the machine-direction tensile strength of the web. A more brittle coating makes the web thicker and more coarse creped and reduces the web tension, while a soft coating of low adhesiveness produces a high caliper, low density paper web of coarse crepe structure, and the web tension is further reduced while the machine-direction tensile strength is increased. In the Sawdai invention as illustrated and described, the doctor blade control function is based solely on the empirically derived functional relation between doctor blade rotation and time. No other control parameters are used and, consequently, an unintentional change in the properties of the coating, for example, will have an adverse effect on the desired properties of the paper web. Since the conditions have changed, the supposedly best doctor blade control function no longer is the best one.

SUMMARY OF THE INVENTION

The object of the present invention is to provide a method of and a device for adjusting the creping conditions so as to substantially minimize or at least counteract a deterioration, caused by doctor blade wear, of a monitored property of the creped web, which method and which device are independent of machine speed and do not require the sampling of data and the averaging thereof over extended periods of time to give an acceptable result.

According to the present invention this object is achieved, in a method of the kind initially stated, by providing a first sensor for measuring on-machine a value of said property of the just creped off paper web to be monitored, said sensor emitting a signal representing the measured value of said property, continually monitoring the signal emitted from said sensor, and, on detecting an undesirable change in said property caused by blade wear, pivoting the bladeholder and the doctor blade held therein around the second rotational axis in response to a change in the signal emitted from the sensor.

Similarly, this object is achieved by providing a device of the kind initially stated with means for continually monitoring on-machine a property of the just creped off paper web, and means for pivoting the bladeholder and the doctor blade held therein around the second rotational axis to increase the impact angle to such an extent as to substantially minimize or at least counteract an undesirable change in said property.

Such a method and such a device also give the advantage of an improved control of the creping operation and, consequently, a more uniform quality of the crepe paper produced.

The doctor blade is changed when an additional increase of the impact angle does not result in a sufficient counteraction to the undesirable change in said monitored property of the just creped off paper web. A worn doctor blade is reground to restore the blade edge and as a result the width of the doctor blade is reduced. Unless special measures are taken, different blade widths result in different "stick-outs" and, with conventional creping doctors, also in different impact angles. To permit the use of doctor blades of different widths, the bladeholder usually is provided with a series of oppositely facing, longitudinally extending internal grooves for accommodating a doctor blade backing movable strip, see U.S. Pat. No. 3,778,861 (Goodnow), for example. During operation of the crepe paper machine these grooves tend to become blocked by dust particles created by the creping of the web, thereby making it difficult for a machine operator to extract the backing strip from one pair of grooves and insert it in another, when the fresh doctor blade differs in width from the worn one to be replaced. In accordance with the present invention this problem is overcome by accepting a different stick-out of the doctor blade from the bladeholder, and pivoting the creping doctor on the two rotational axes so as to set a predetermined impact starting angle for the new doctor blade.

The web property to be continually monitored suitably is the caliper and/or the crepe macrostructure of the just creped off paper web. The grade of wear of the doctor blade and the ensuing reduction of the impact angle have a direct effect on these properties and, in contrast to the machine-direction tensile strength, these properties can be measured on-machine.

For monitoring the crepe macrostructure, it is recommendable to use a crepe macrostructure measuring means including a laser light source for directing a laser beam onto the just creped off paper web, which on reflecting the laser beam produces a back scattered laser beam, said crepe macrostructure measuring means further including an optoelectronic cell for receiving some of the back scattered laser beam, and a system for processing signals from the optoelectronic cell to determine the crepe macrostructure. The measurement results obtained are believed to be accurate also at high web speeds on the order of 1,800 m/min.

In a preferred embodiment, the invention comprises connecting a servomotor to the bladeholder for pivoting the bladeholder and the doctor blade held therein around the second rotational axis, providing a control unit for controlling the servomotor, said control unit being able to detect a change in an incoming signal, and feeding the signal emitted from the sensor as an incoming signal to the control unit, whereby a change in the signal emitted from the sensor automatically causes the servomotor to pivot the bladeholder and thereby change the impact angle of the doctor blade so as to substantially minimize or at least counteract the measured change in the monitored property of the web. While it is possible to have a machine operator check the property to be monitored and pivot the bladeholder manually to change the impact angle, automatic operation usually is more precise and more reliable.

Preferably, the invention also comprises providing a second sensor for measuring on-machine a value representing a creping affecting property of an adhesive coating on the movable creping surface, said second sensor emitting a signal representing the measured value of said creping affecting property of the adhesive coating, continually monitoring the signals emitted from said first and second sensors, and, on detecting a simultaneous undesirable change both in the creping affecting property of the adhesive coating and in the monitored property of the just creped off paper web, adjusting the creping affecting property to such an extent as to substantially minimize or at least counteract the undesirable change in the monitored property of the just creped off paper web, and carrying out the adjusting of the creping affecting property prior to commencing the pivoting of the bladeholder and the doctor blade held therein. Thereby, a possible undesirable change in the creping affecting property of the adhesive coating, which wholly or partly may be the cause of the undesirable change in the monitored property of the web, will be corrected before any remaining undesirable change in the monitored property of the web is adjusted by the pivoting of the bladeholder.

The creping affecting property suitably is adjusted by changing the amounts of ingredients in a coating composition to be applied to the movable creping surface to form the adhesive coating, said coating composition containing an adhesive agent, a release agent, and water. Advantageously, this adjustment can be carried out by providing a first dosing pump for the adhesive agent, a second dosing pump for the release agent, and a control unit for controlling the dosing pumps, said control unit being able to detect a change in incoming signals, and feeding the signals emitted from the first and second sensors as incoming signals to the control unit, whereby said control unit on detecting simultaneous undesirable changes in the creping affecting property of the coating and in said monitored property of the just creped off paper web automatically controls the dosing pumps to change the creping affecting property of the coating so as to substantially minimize or at least counteract the measured change in said monitored property of the just creped off paper web.

Further, the method suitably includes continually monitoring a moisture content in the just creped off paper web, moisture in the web influencing the creping affecting property of the coating, and, on detecting an undesirable change in said moisture content, finding and eliminating the cause of the change in the moisture content prior to adjusting the creping affecting property. Thereby, a possible undesired change in the moisture content, which change may be caused by an error earlier in the papermaking process, will be detected and corrected before any remaining change in the creping affecting property of the coating is adjusted.

Preferably, the second sensor is a sensor for measuring a tension in the just creped off paper web, said web tension correlating with the creping affecting property of the coating. Conventional web tension sensors operating either with load cells mounted in roll bearings or with acoustic transmitters are not applicable for soft crepe paper grades.

Therefore, the web tension sensor suitably is of non-contacting type and includes a feeler, means for pressing the feeler towards the web with a constant force, means for creating a gas cushion of a predetermined thickness between the feeler and the web to prevent the feeler from contacting the web, and means for determining the position of the feeler in relation to a fixed point, said position representing the web tension.

In addition to the properties of the coating, web tension is also affected by the crepe ratio. Crepe ratio is defined as the difference between the creping surface speed (Y) and the web speed (S) at the reel, divided by the creping surface speed, i.e. (Y–S)/Y. Most soft crepe paper products are produced at crepe ratios of 15% to 25%. A small crepe ratio gives a high web tension, which reduces web flutter and improves the transfer of the web from the movable creping surface to the reel, but a too high web tension will result in an increased number of web breaks and reduced production. The desired crepe ratio is set in a programmable unit for the control of the speeds of the papermaking machine and the reel. Once set, the crepe ratio is regarded as constant, and the speed controlling unit constitutes no part of the present invention.

BRIEF DESCRIPTION OF THE DRAWINGS

FIG. 10 is a fragmentary cross sectional view illustrating an alternative embodiment, in which two rows of guide rollers are substituted for the guide rail disclosed in FIGS. 5 and 6.

FIG. 11 is a fragmentary cross sectional view taken upon line XI—XI of FIG. 10.

FIG. 12 is an enlarged scale, fragmentary side elevational view of a doctor blade having its tip in contacting relation with the cylinder surface of a Yankee dryer as shown in FIG. 1, for example, and in which the thickness of the doctor blade is greatly exaggerated relative to the radius of the cylinder surface.

DETAILED DESCRIPTION OF THE PREFERRED EMBODIMENTS

Figure 1:
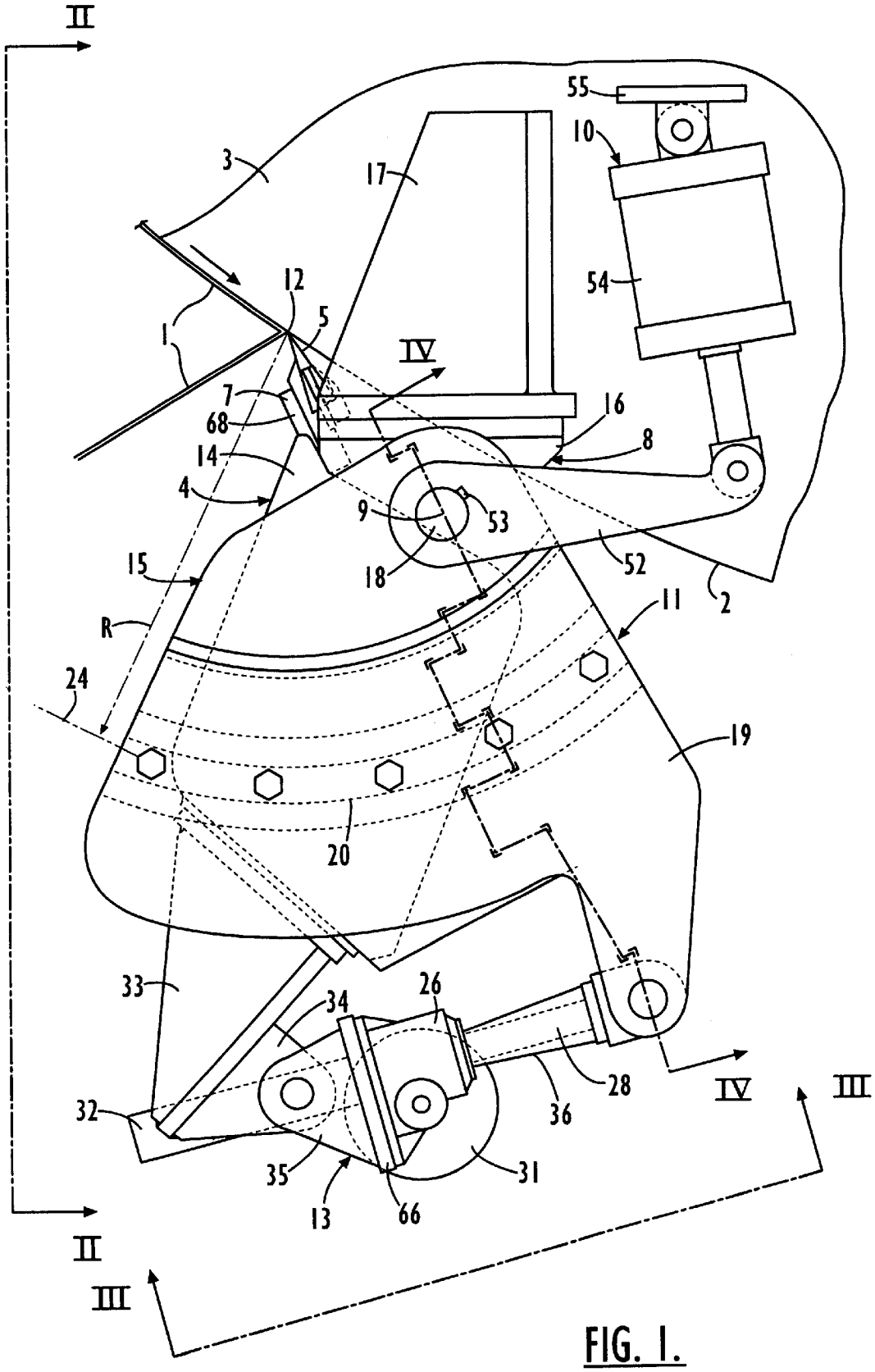
FIG. 1 is a slightly simplified side elevational view of a creping doctor apparatus used for creping off a paper web from the cylinder surface of a Yankee dryer, and which apparatus incorporates means for pivoting the apparatus on a first rotational axis so as to permit blade exchange, and means for pivoting the creping doctor substantially around the tip of the doctor blade so as to permit adjustment of the impact angle.
Figure 2:
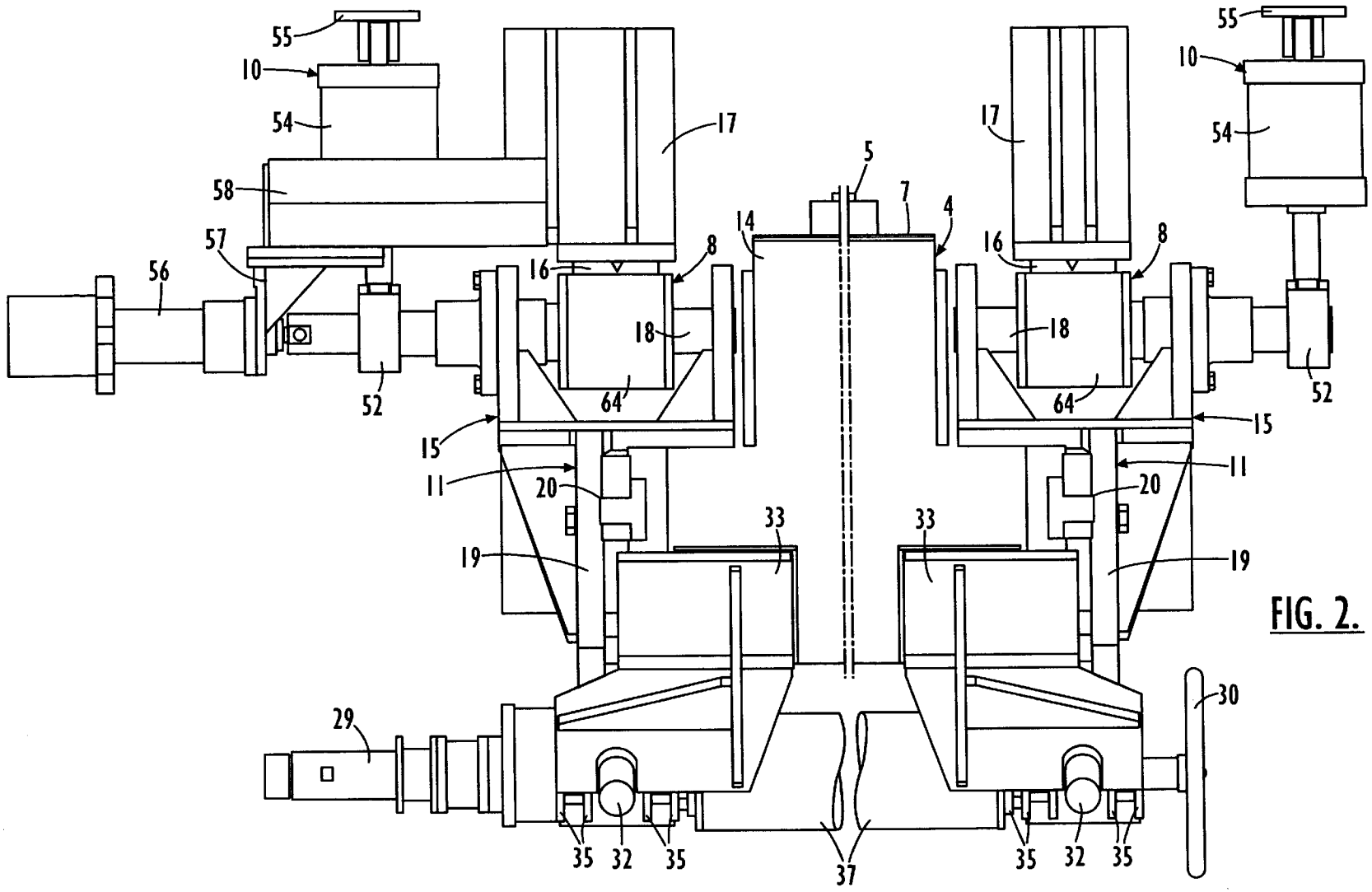
FIG. 2 is a longitudinal elevational view of the apparatus as viewed from line II—II in FIG. 1.
Figure 3:
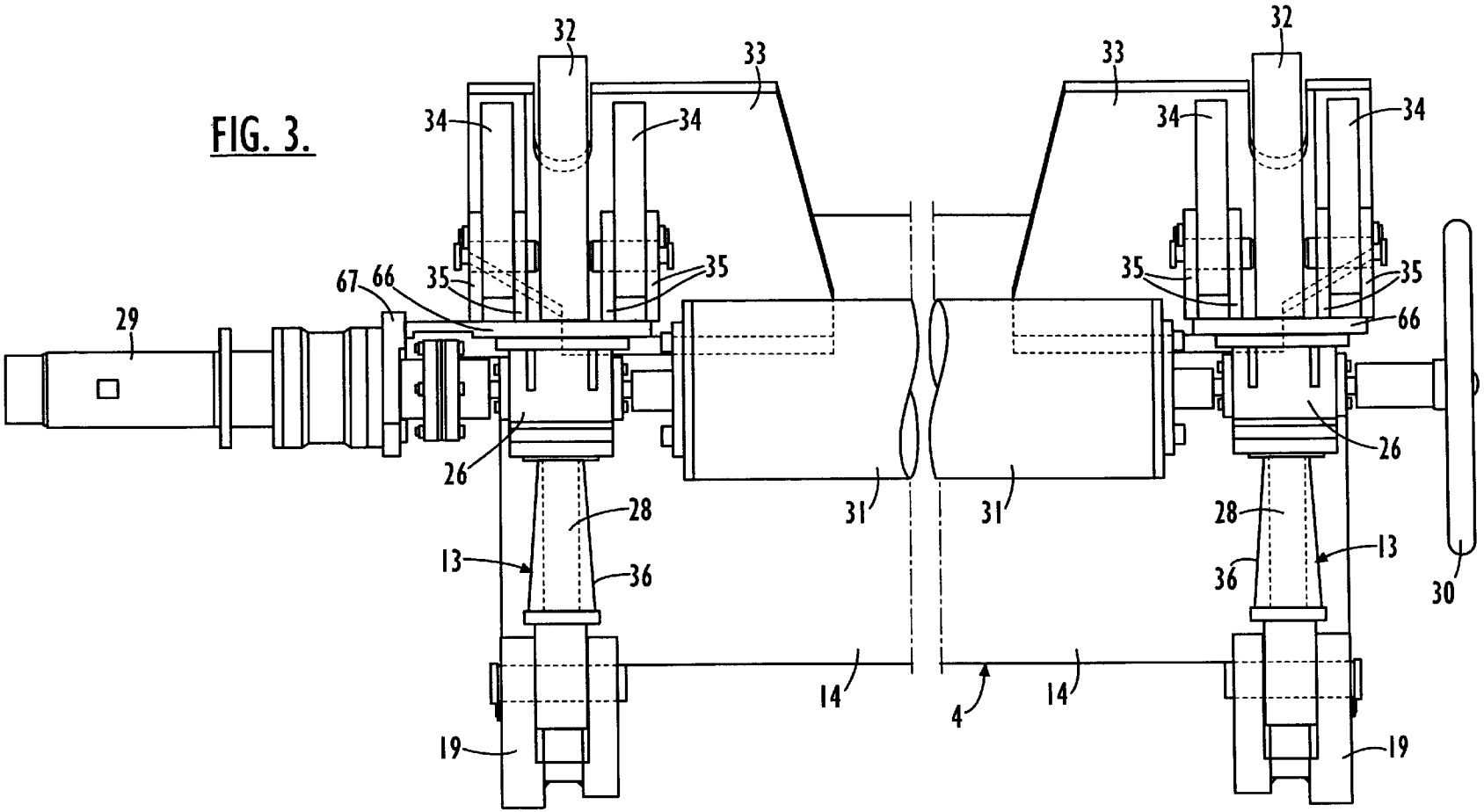
FIG. 3 is a longitudinal elevational bottom view of the apparatus as viewed from line III—III in FIG. 1.

FIGS. 1 to 3 are different views of an apparatus for adjusting the creping conditions when creping off a paper web 1 by means of a creping doctor 4 from a paper machine creping surface 2, to which the paper web 1 adheres. The apparatus is the subject of U.S. patent application Ser. No. 07/936,602, now U.S. Pat. No. 8,403,446, filed concurrently herewith (claiming priority from Swedish patent application No. 9102498-4 for "Apparatus for Adjusting the Creping Conditions" filed on Sep. 2, 1991) and assigned to the assignee of the present application. As a rule, the creping surface 2 is the cylinder surface of a Yankee dryer 3. The creping doctor 4 has an elongate doctor blade 5 with a working edge 6 that is shown most clearly in FIG. 12. The doctor blade extends over the width of the web 1 and is mounted in a bladeholder 7, which in the illustrated embodiment is of the type marketed under the trade name "Conformatic" by Lodding Engineering Corporation, Auburn, Mass., U.S.A., and is disclosed in FIG. 2 of U.S. Pat. No. 3,778,861 to Goodnow, incorporated herein by reference.

Figure 9:
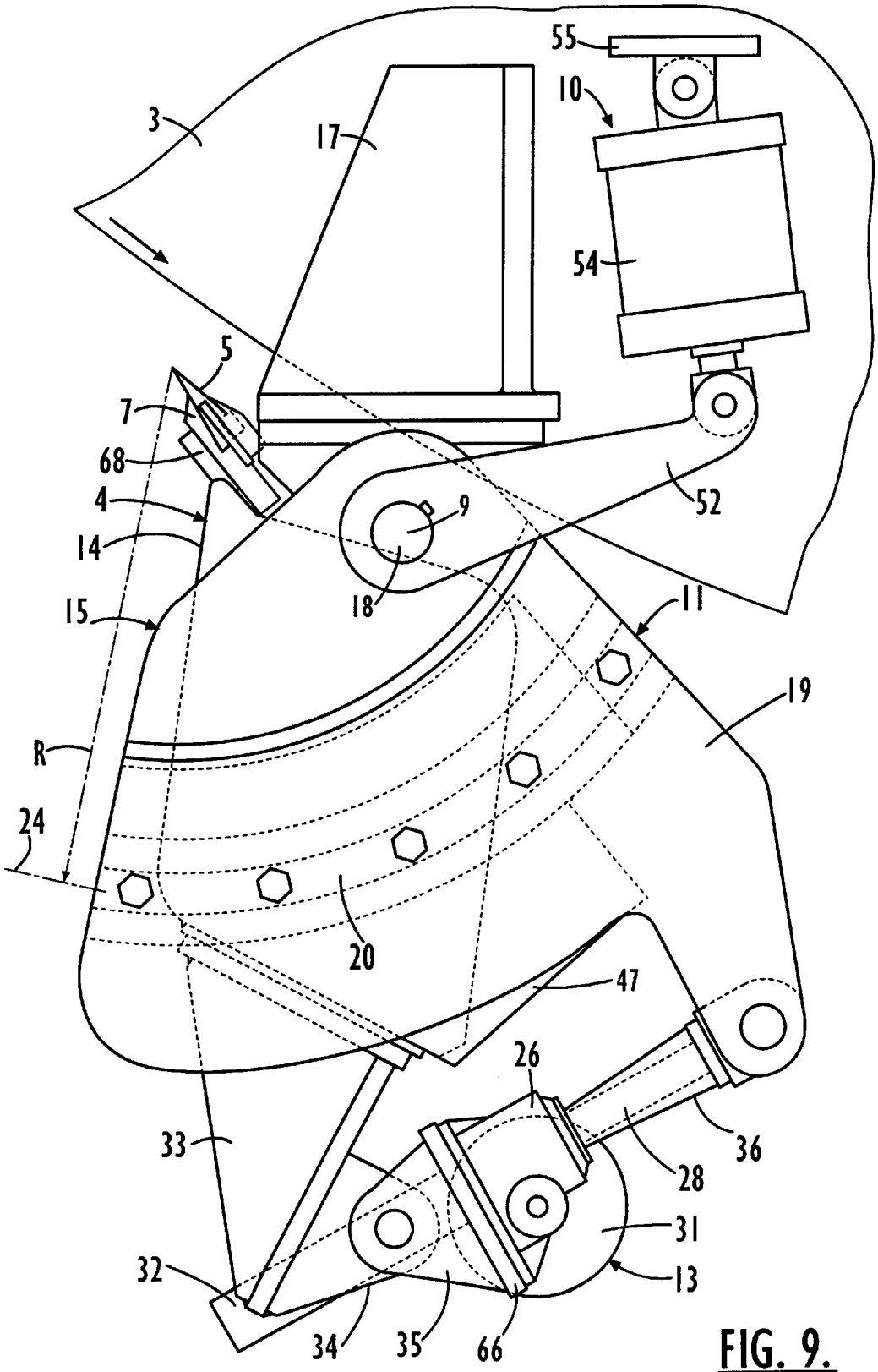
FIG. 9 is a side elevational view similar to FIG. 1 illustrating the creping doctor apparatus when pivoted to an inactive position permitting the exchange of a worn doctor blade.

The creping doctor apparatus has means, generally designated 8, for defining a first rotational axis 9 for the creping doctor 4 parallel to the blade working edge 6 and located at a distance of at least 0.2 meters therefrom for permitting the doctor blade to be pivoted to an active first position, as shown in FIG. 1, for creping off the web 1, and an inactive second position, as shown in FIG. 9, in which a worn doctor blade may be removed from the bladeholder 7 and a fresh doctor blade 5 inserted thereinto. Means, generally designated 10, are provided for pivoting the creping doctor 4 on the first rotational axis 9.

The creping doctor apparatus further has means, generally designated 11, for defining a second rotational axis 12 parallel to the blade working edge 6 and located within 15 millimeters therefrom for permitting the setting of an arbitrary impact angle A formed at the blade working edge 6 between an impact surface of the working edge 6 and the creping surface 2 (or more correct a tangent to the creping surface at a point where the working edge contacts the creping surface). Means, generally designated 13, are provided for pivoting the creping doctor 4 on the second rotational axis 12 to set the impact angle A.

The creping doctor 4 includes an elongate beam member 14 having two ends and carrying the bladeholder 7. More specifically, the beam member 14 has a longitudinally extending integral fin 68, on which the bladeholder 7 is attached by means of screws, not shown. The means 8 for defining the first rotational axis 9 include two coaxial pivot pin devices, generally designated 15, connected to the beam member 14, one at each end thereof, and means, generally designated 16, for supporting the pivot pin devices 15. The supporting means 16 are adapted to be secured to a paper machine frame member, a portion of which is shown in the drawings and designated 17. Each pivot pin device 15 includes a pivot pin 18 and an end wall 19, which is non-rotatably and perpendicularly secured to the pivot pin 18. The two end walls 19 are located parallel to each other, one immediately outside each end of the elongate beam member 14.

The means 11 for defining the second rotational axis 12 include means, generally designated 20, for guiding a lateral displacement of the beam member 14 in a direction parallel to the two end walls 19. These guiding means 20 include, for each pair of beam member end and associated end wall 19, structural portions 21 and 22 that define a first guide member 23 of elongated shape extending along a circular arc 24 having a radius of curvature R, which starts from the desired location of the second rotational axis 12. The guiding means 20 further include a second guide member 25 adapted to the shape of the first guide member 23 and cooperating therewith. The two guide members 23 and 25 are interlocking to permit movement of the one in relation to the other exclusively along the circular arc 24, and one of the guide members, in the shown embodiment guide member 23, is provided on the beam member 14, and the other guide member is provided on the end wall 19, thereby forming a pivotal connection (around axis 12) between each pivot pin device 15 and the beam member 14 ends.

The means 13 for pivoting the creping doctor 4 on the second rotational axis 12 are operatively connected between the beam member 14 and the end walls 19 for displacing the beam member 14 in a lateral direction parallel to the end walls 19, and the means 10 for pivoting the creping doctor 4 on the first rotational axis 9 are supported by the paper machine frame member (at a position not shown) and operatively connected to rotate the pivot pins 18.

FIG. 12 illustrates the operative relationship between the doctor blade 5 and the Yankee dryer 3. To facilitate identification of the various angular relationships and angles, the thickness of the blade is greatly exaggerated with respect to the radius of the Yankee dryer. Commonly used creping doctor blades as a rule have a thickness on the order of 1.2 millimeters while the diameter of the Yankee dryer can vary from about 3 meters to about 5.5 meters or more. In FIG. 12 the tip of the doctor blade 5 is shown as being cut perpendicularly, but many soft crepe paper producers prefer to use a bevelled tip having an included angle B of less than 90° and, therefore, the surface of the doctor blade 5 to which the impact angle A is measured is commonly called the bevel surface. As used herein, the impact angle A is the plane angle defined by the bevel surface of the doctor blade 5 and by the upstream segment of a plane tangent T to the cylinder surface 2 of the Yankee dryer 3 at the point of intersection of cylinder surface 2 and doctor blade 5, and the set-up angle C is the plane angle defined by the rear side of the doctor blade 5 and by the downstream segment of the tangent T. Typically, the impact angle A is from about 80° to about 95°, the included angle B of the blade tip is from 90° to about 60°, and the set-up angle C is from about 15° to about 30°. The impact angle controls the result of the creping operation, i.e. the caliper and/or the macrostructure and/or some other important characteristic property of the creped paper web. During operation the working edge 6 of the doctor blade 5 is being worn, which causes a change in the impact angle A. To maintain the desired caliper, macrostructure or other characteristic property as far as possible it is necessary to compensate for the wear of the blade working edge 6 by pivoting the doctor blade 5 substantially around its working edge 6 so as to maintain the impact angle A. According to the present invention the impact angle is adjusted by pivoting the creping doctor 4 on the second rotational axis 12, which is located within 15 millimeters from the working edge 6 and preferably coincides with said working edge.

Figure 7:
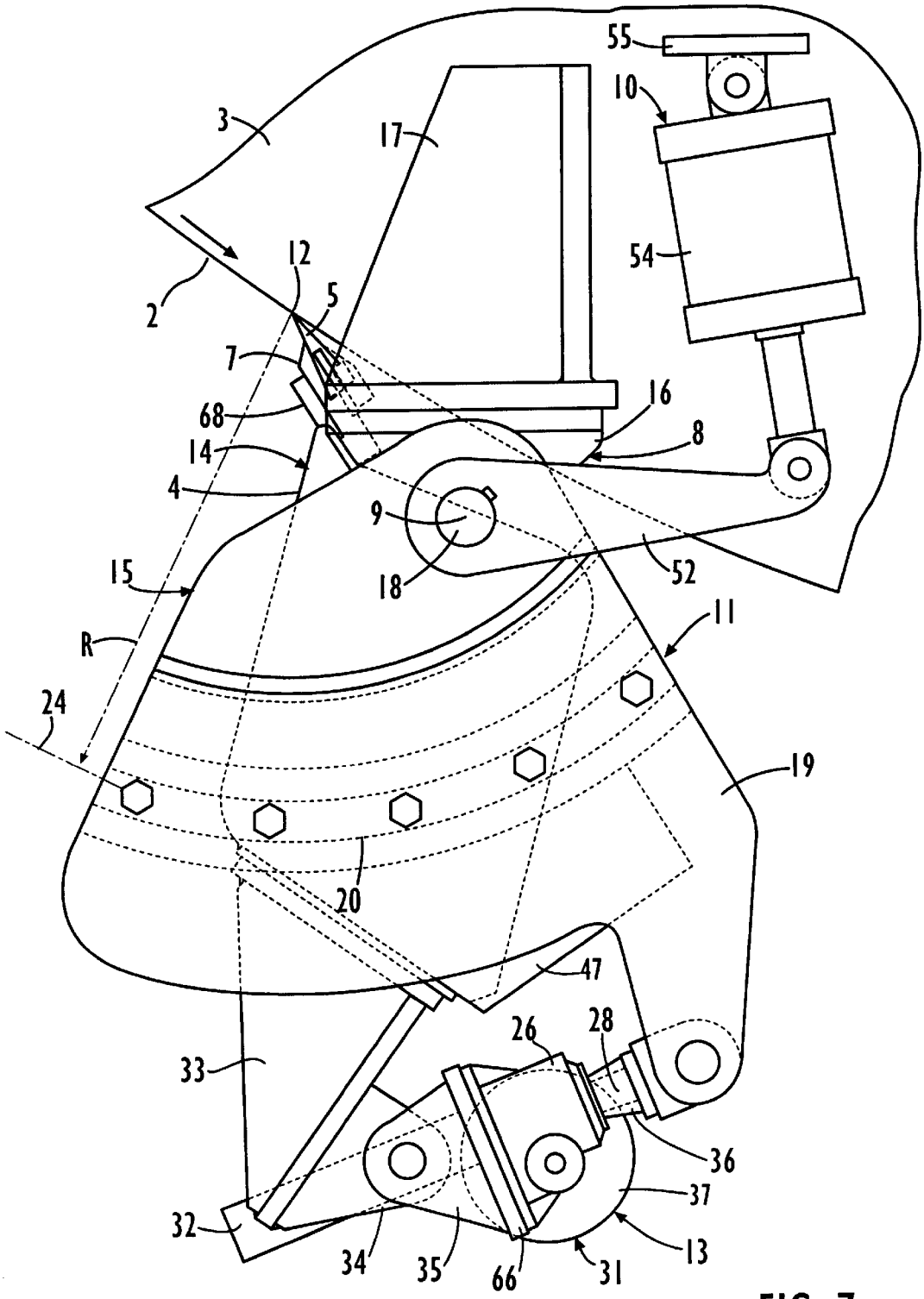
FIG. 7 is a side elevational view similar to FIG. 1 illustrating the creping doctor as pivoted around the tip of the doctor blade to set a maximum impact angle.
Figure 8:
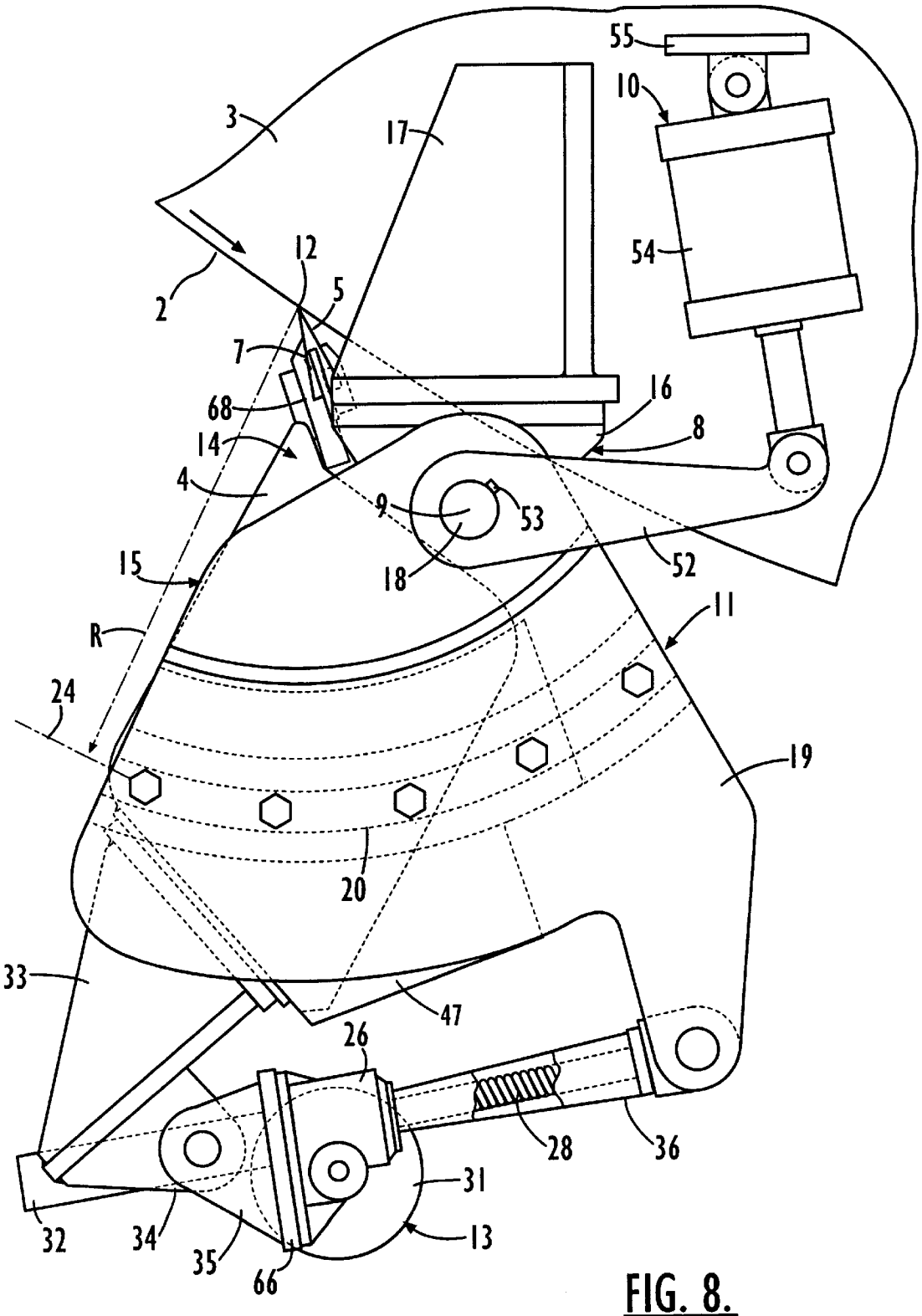
FIG. 8 is a side elevational view similar to FIG. 1 illustrating the creping doctor as pivoted around the tip of the doctor blade to set a minimum impact angle.

While FIG. 1 illustrates the creping doctor apparatus when the set-up angle, which above is designated C, is about 22.5°, FIGS. 7 and 8 show the apparatus after the creping doctor 4 has been pivoted around the working edge of the doctor blade to a right-hand end position, which results in a minimum set-up angle of about 15°, and to a left-hand end position, which results in a maximum set-up angle of about 30°, respectively. Assuming that the included angle of the blade tip is 70°, for example, the above values of the set-up angle correspond to an impact angle of 87.5° in FIG. 1, and of 95° and 80° in FIGS. 7 and 8, respectively. FIGS. 7 and 8 clearly illustrate how the creping doctor 4 and its beam member 14, which is indicated in broken lines behind the end wall 19, shift their position in relation to the end wall 19 in order to adjust the set-up angle and, consequently, the impact angle. A lateral displacement of the creping doctor 4 in a direction parallel to the planes of the end walls 19 does not affect the positions of the two end walls 19.

Preferably, the means 13 for pivoting the creping doctor 4 on the second rotational axis 12 include two rotary to translatory motion transforming mechanisms 13, one located at each end of the beam member 14. Each mechanism 13 comprises a housing 26 pivotally secured to the beam member 14; a drive member rotatably journaled in the housing 26; an elongate positioning driven member 28 (shown in FIG. 8) extending through the housing 26 in meshing engagement with the drive member, said driven member 28 having one end non-rotatably and pivotally secured to the end wall 19 of the adjacent pivot pin device 15 in a position such that the driven member 28 extends substantially parallel to a tangent (not shown) to the guiding means 20, said driven member 28 being displaced longitudinally upon rotation of the drive member; and means 29 and/or 30 for rotating the drive member.

Different types of motion transforming mechanisms may be used, e.g. one in which the drive member is a pinion and the driven member is a rack, but preferably the mechanism is an anti backlash screw jack 13, the drive member is a nut, and the driven member is a positioning screw 28 (FIG. 8) extending through the nut. A suitable screw jack is the anti backlash actuator marketed by Duff Norton Co., Charlotte, N.C., USA, under the designation SK-9005-501X. It is also preferred that means 31 are provided for mechanically interconnecting the two motion transforming mechanisms 13 in a manner such that a rotation of one of the drive members causes a corresponding rotation of the other one. The interconnecting means may be a shaft, suitably a tubular shaft 31 in order to optimize weight and torsional stiffness to each other.

The free end portion of the positioning screw 28 is surrounded by a protective tube 32 secured to the housing 26 and having a closed end. For securing the two housings 26 pivotally to the beam member 14, two brackets 33 are fixed to a bottom surface of the beam member 14, one at each end of the beam member 14. Each bracket 33 has two identical parallel lugs 34, which are journaled in two pillow blocks 35 fixed in diametrically opposed positions, one on each side of the protective tube 32, on a common bottom plate 66 attached to the housing 26. The other screw end portion, which is pivotally attached to the end wall 19, is surrounded by an axially deformable protective sheath 36 that may be a bellows, for example, but in the shown embodiment is a steel strip wound into a tight spiral and having its inner end fixed to the housing 26 and its outer end fixed to the pivotally attached end of the screw 28. A protective sheath of this kind is marketed under the trade mark CentryCover by Centryco. Centrexport & Central Safety Equipment Co. Inc., Burlington, N.J., USA.

Figure 4:
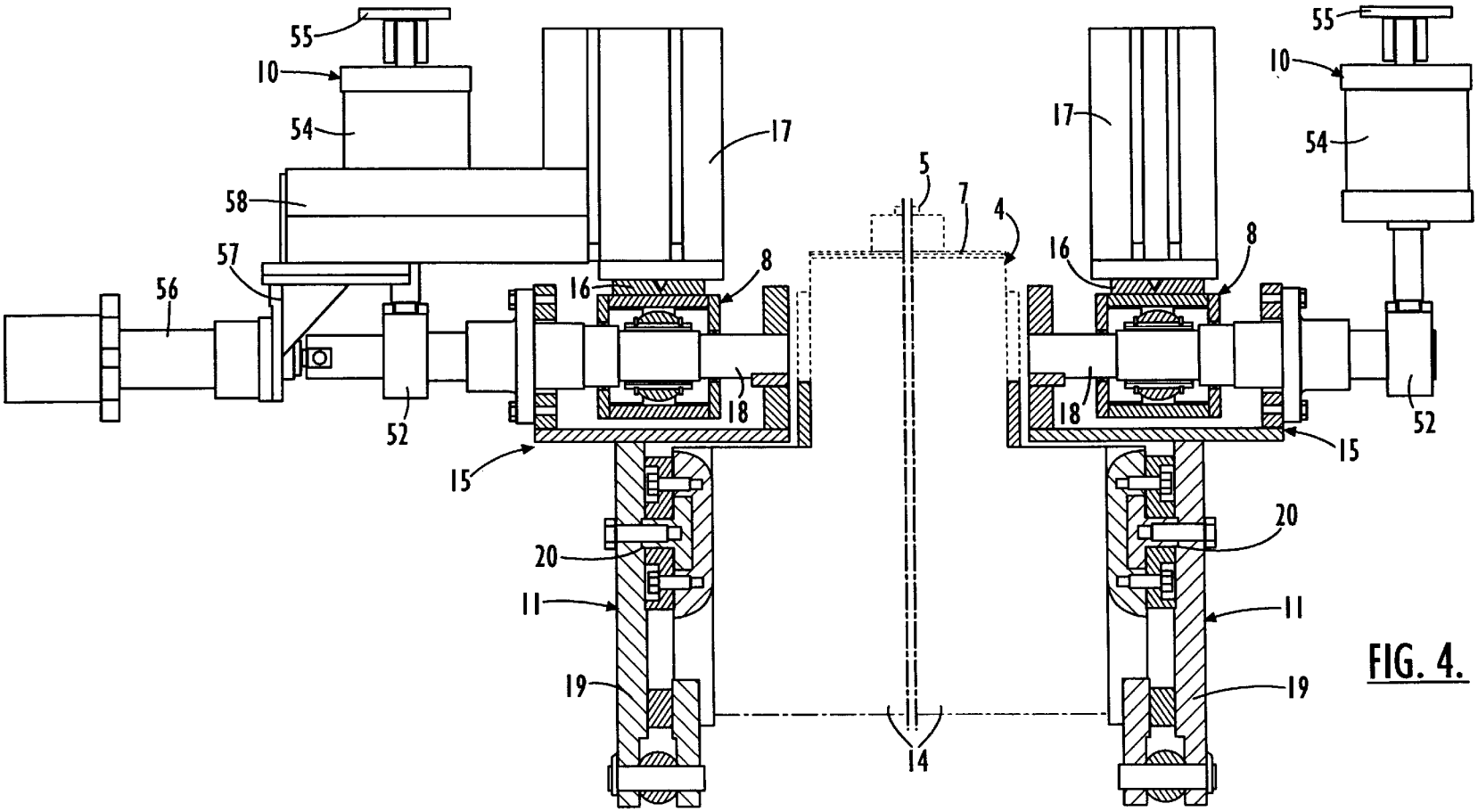
FIG. 4 is a cross sectional view of the apparatus taken upon line IV—IV of FIG. 1.
Figure 5:
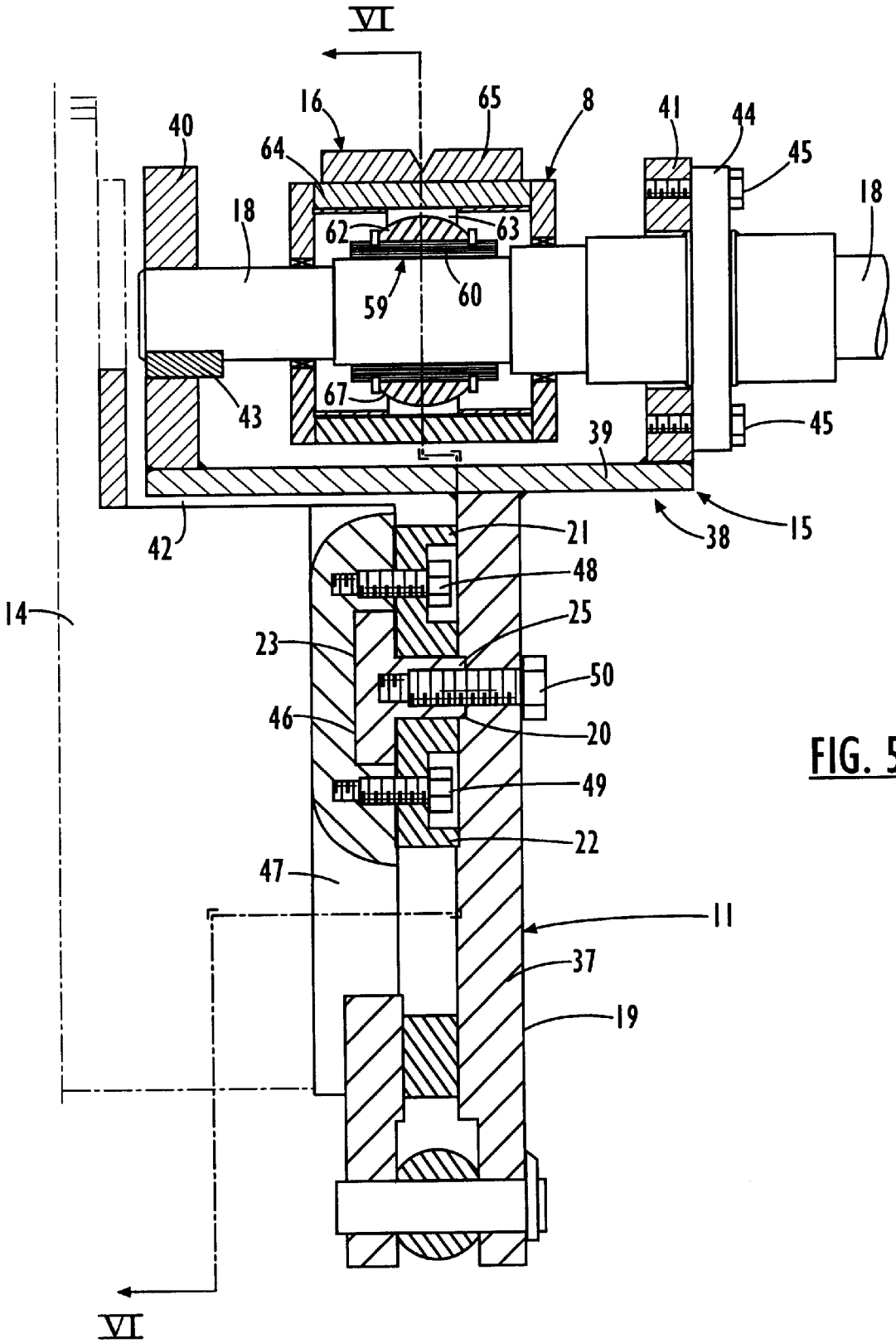
FIG. 5 is an enlarged scale detail of a portion of FIG. 4 and shows the guiding means, which guide the pivotal movement of the creping doctor around the tip of the doctor blade, the bearing means provided for the oscillation of the creping doctor, and the supporting means provided for permitting tipping of the apparatus for exchange of a worn doctor blade and oscillation.

Of the two means for rotating the drive member, one is a motor 29 and the other is a hand-wheel 30. The motor 29, which has a step-down gear with a considerable reduction ratio, is located on the drive side of the paper machine and is supported by a bracket 67 integral with the bottom plate 66 of the two pillow blocks 35 shown in the left-hand portion of FIG. 3. Each of the two screw jacks 13 has a through drive shaft having an inner and an outer end. The inner ends are interconnected by means of the intermediate shaft 31, the step-down gear of motor 29 is connected to one of the outer shaft ends, and the handwheel 30 is connected to the other outer shaft end. Consequently, the handwheel 30 is located on the operational side of the paper machine. The handwheel 30 is used for manually adjusting the impact angle A of the doctor blade in case the motor 29 should fall out for some reason. As best shown in FIGS. 4 and 5, each of the end walls 19 has a lower plate-shaped portion 37 and an upper channel-shaped portion 38 fixed to the plate-shaped portion 37. The channel-shaped portion 38 has a bottom wall 39 and two side walls 40 and 41. The bottom wall 39 is curved so as to make all portions thereof equidistantly spaced from the second rotational axis 12, which is located at the working edge 6 of the doctor blade, while the two side walls 40 and 41 are parallel to each other and to the lower plate-shaped portion 37 of the end wall 19. As to shape, the channel-shaped portion 38 has a symmetry plane, which is parallel to the plate-shaped portion 37 but located on the beam member side thereof. To accommodate the part of the channel-shaped portion 38 that is located next to the beam member 14, the beam member is provided with a corresponding recess 42 with sufficient clearance to the bottom wall 39 and the adjacent side wall 40 of the channel-shaped portion 38 to permit the lateral movement of the beam member 14 in a direction parallel to the end walls 19.

Each of the pivot pins 18 has one end fixed in the side wall 40, in the shown embodiment by means of a key 43, and extends through the other side wall 41, where it is axially fixed by means of a welded-on flange 44 that is secured to the side wall 41 by suitable fasteners, such as screws 45.

In the embodiment shown in FIGS. 5 and 6 the first guide member 23 is a guide slot located in the beam member 14 end below the recess 42, and the second guide member 25 is guide rail adapted to the shape of the guide slot and located on the lower plate-shaped portion 37 of the end wall 19. The illustrated guide slot 23 is of T-shaped cross section and is formed by a groove 46 of rectangular cross section provided in an end wall 47 of the beam member 14 and an upper and a lower guide plate 21 and 22, respectively, which are adjustably mounted on the end wall 47 of the beam member 14, e.g. by a series of screws 48 and 49, respectively, and partly cover the groove 46 along its length to define the T-shaped cross section of the guide slot 23. Consequently, also the guide rail 25 is of T-shaped cross section, and it is mounted on the lower plate-shaped portion 37 of the end wall 19 by means of a series of screws 50. The guide rail 25 does not touch the bottom or the sides of the groove 46. The guiding effect is provided exclusively by the two adjustable guide plates 21 and 22, the guide rail 25 and the associated surfaces of the end wall 19. A plurality of grease nipples and conduits, not shown, are provided for lubrication of the guide surfaces.

Figure 6:
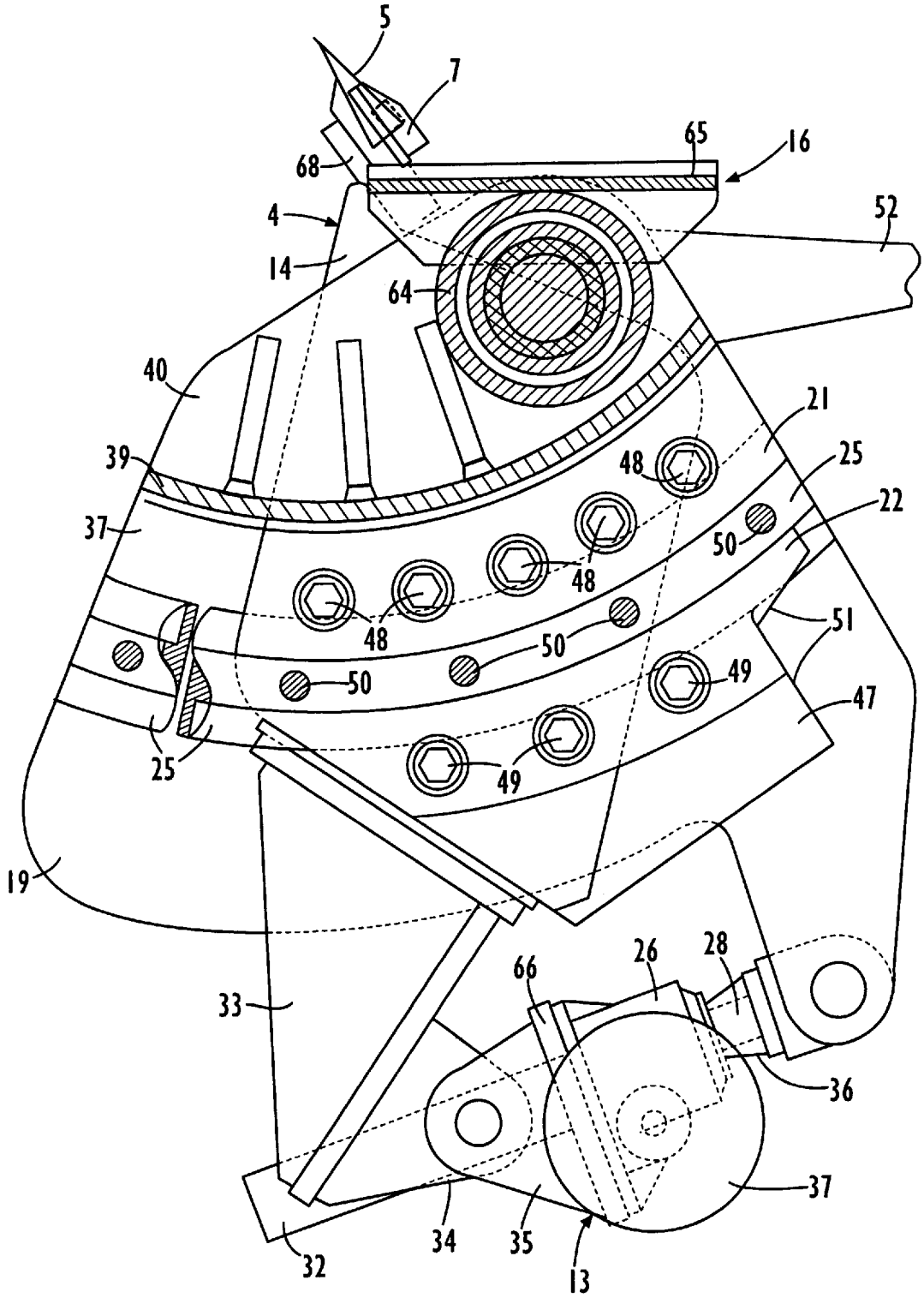
FIG. 6 is a cross sectional view taken upon line VI—VI of FIG. 5.

While the illustrated beam member 14 is of substantially rhomboidal cross section, its end walls 47 extend outside thereof, on the right-hand side as viewed in FIG. 6, to provide adequate support and attachment points for the two guide plates 21 and 22. A recess 51 is provided in the right-hand corner of the beam member end wall 47 as viewed in FIG. 6 in order to permit the mounting of a shower tube, not shown, between the two end walls 19 for showering the cylinder surface 2 of the Yankee dryer 3, when the creping doctor is non-operational.

The means 10 for pivoting the creping doctor 4 on the first rotational axis 9 include on each side of the paper machine a lever 52 and an actuator 54. The lever 52 is non-rotatably secured by means of a key 53, shown in FIG. 1, to the free end of the right-hand pivot pin 18 as viewed in FIGS. 2 and 4. The left-hand pivot pin has an extended free end, which projects axially from an identical lever secured non-rotatably to the left-hand pivot pin. The free end of each lever 52 is pivotally connected to the associated actuator 54, which is pivotally mounted in a pillow block 55 adapted to be anchored to a bracket, not shown, that is included in the paper machine frame member 17. The two actuators 54 are used for pivoting the creping doctor on the pivot pins 18 between two positions, namely an active one, in which the doctor blade 5 engages the cylinder surface 2 of the Yankee dryer 3 as shown in FIG. 1, and an inactive one, in which the doctor blade 5 is swung out from the cylinder surface 2, as shown in FIG. 9, to permit the replacement of a worn blade. On comparison of FIG. 9 to FIG. 1 it is evident that the pivoting of the entire apparatus by means of the actuators 54 does not affect the position of the creping doctor 4 and its beam member 14 (shown in broken lines) in relation to the position of the end wall 19.

The doctor blade 5 is changed when an additional increase of the impact angle A does not result in a sufficient counteraction to an undesirable change in at least one monitored property of the just creped off paper web. A worn doctor blade is reground to restore the working edge 6 of the doctor blade, and as a result the width of the doctor blade 5 is reduced. Unless special measures are taken, different blade widths result in different "stick-outs" and, with conventional creping doctors, also in different impact angles. To permit the use of doctor blades of different widths, the bladeholder usually is provided with a series of oppositely facing, longitudinally extending internal grooves for accommodating a doctor blade backing movable strip, see U.S. Pat. No. 3,778,861 (Goodnow), for example. During operation of the crepe paper machine these grooves tend to become blocked by dust particles created by the creping of the web, thereby making it difficult for a machine operator to extract the backing strip from one pair of grooves and insert it in another, when the fresh doctor blade differs in width from the worn one to be replaced. In accordance with the present invention this problem is overcome by accepting a different stick-out of the doctor blade 5 from the bladeholder 7, and pivoting the creping doctor 4 on the two rotational axes 9 and 12 so as to set a predetermined impact starting angle A for the new doctor blade 5.

The extended free end of the left-hand pivot pin 18 as viewed in FIGS. 2 and 4 is operatively connected to an oscillator 56 for continuously oscillating the creping doctor 4 in order to avoid the formation of grooves in the creping surface 2. The oscillator 56 is mounted on a bracket 57 carried by an arm 58 mounted to the paper machine frame member 17. As a rule, the movement effected by the oscillator is on the order of 6 to 18 millimeters at a suitable frequency, such as 15 strokes per minute, for example.

For permitting axial oscillation of the creping doctor 4 relative to the supporting means 16, bearing means 59 are provided in association with each of the pivot pin devices 15 and the adjacent supporting means 16 as is best shown in FIGS. 4 and 5. Each bearing means 59 includes a bushing 60 that is axially displaceable on a portion of the pivot pin 18 located half-way between the two side walls 40 and 41 of the channel-shaped portion 39 of the end wall 19. The supporting means 16 includes a self-aligning bearing 61 having an inner ring 62, which is mounted on the bushing 60, and an outer ring 63, a surrounding housing 64 in which the outer ring 63 is mounted, and a bracket member 65 to which the housing 64 is secured. The bracket member 65, which may be integral with the housing 64, is adapted to be secured to the frame member 17 of the paper machine and is shown mounted to the frame member. Each of the two self-aligning bearings 61 has a central symmetry plane, which extends perpendicularly to the first rotational axis 9 for the creping doctor 4 and coincides with the uppermost portion of line VI—VI in FIG. 5, and each of the positioning screws 28 has a center line, not indicated. These center lines are located one in each of the two central symmetry planes of the two self-aligning bearings 61.

Also in the embodiment shown in FIGS. 10 and 11 the first guide member 23 is a circularly arched guide slot, here designated 71, located in the end wall 47 of the beam member 14, but the second guide member includes two circularly arched rows of guide rollers 70 instead of being a guide rail. The guide rollers 70 are adjustably mounted to the lower plate-shaped portion 37 of the end wall 19 by means of screws, not shown. The guide slot 71 is defined by two circularly arched opposed side walls 72 extending parallel to each other, and in each of the side walls 72 there is provided a recessed raceway 73 for the rollers 70. The cooperation between the guide rollers 70 and the recessed raceways 73 provides an interlocking effect that permits movement of the beam member 14 in relation to the end wall 19 exclusively around the second rotational axis 12 at the working edge 6 of the doctor blade 5. An end cover 74 is provided at each end of the guide slot 71, and in order to seal off the guide slot from the environment, a flat rubber seal ring 75 is mounted on the exterior side of the two side walls 72 and the end covers 74 and bridges a clearance to the lower plate-shaped portion 37 of the end wall 19.

While the creping doctor apparatus above has been described with reference to the drawings, which show two preferred embodiments, several obvious modifications thereof are possible. As an illustrative example it would be obvious to modify the embodiment disclosed in FIGS. 10 and 11 by eliminating the guide slot and substituting a single guide rail for the two side walls that presently define the guide slot, and by locating the recessed raceways for the two rows of guide rollers on opposite sides of the single guide rail. The end covers could remain substantially unchanged, but to permit the mounting of the flat rubber seal ring, the beam member end wall could be provided with two fin members serving to connect the two ends of the one end cover with the two ends of the other. It would also be possible, but less preferred, to use another type of means than the disclosed screw jack for pivoting the creping doctor on the second rotational axis. For example, with the exception of a lug for the attachment of the positioning screw of the screw jack, the bottom portion of the end wall is circularly curved around the second rotational axis at the working edge of the doctor blade. The lug could be dispensed with, the curved bottom portion of the end wall could be provided with teeth to form a toothed rack member, and a step-down gear having a drive pinion meshing with the toothed rack member could be installed. A rotation of the pinion would displace the pinion along the toothed rack member and, thus, pivot the creping doctor substantially around the working edge of the doctor blade.

Figure 13:
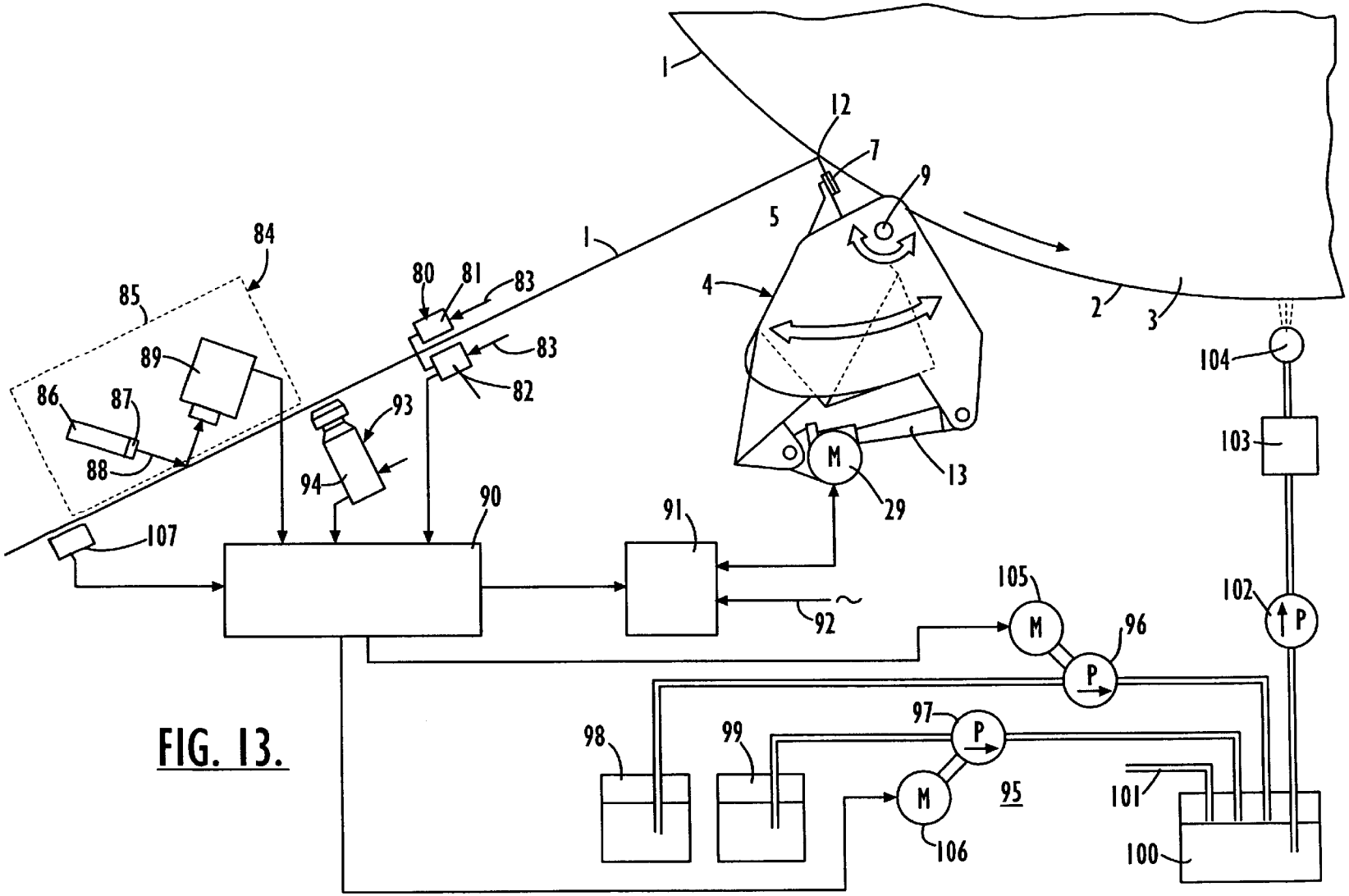
FIG. 13 is a block diagram of a preferred embodiment of a device for adjusting the creping conditions by controlling the impact angle and the properties of an adhesive coating on a movable creping surface, e.g. the cylinder surface of a Yankee dryer.

FIG. 13 is a block diagram showing a preferred embodiment of the device for controlling the creping conditions in accordance with the present invention. The creping apparatus is the one described above and shown in FIGS. 1–12, and it has a creping doctor 4 for creping off the paper web 1 from a creping surface 2, such as the cylinder surface of a Yankee dryer 3, to which the paper web 1 adheres. The creping doctor 4 has an elongate doctor blade 5, which has a working edge 6 (FIG. 12) and is mounted in a bladeholder 7, and the creping doctor 4 is mounted to be pivotable on a first rotational axis 9 that is parallel to the blade 5 and located at a distance from the creping surface 2 to permit the blade 5 to be pivoted to an active first position for creping off the web 1, as shown in FIG. 13, and an inactive second position, shown in FIG. 9, in which a worn blade may be removed from the bladeholder 7 and a fresh blade inserted thereinto. The bladeholder 7 and the doctor blade 5 held thereby are mounted to be pivotable around a second rotational axis 12, which is parallel to the working edge of the doctor blade 5 and located within 15 millimeters from the working edge, for setting an arbitrary impact angle A (FIG. 12) formed at the blade edge between an impact surface of the blade edge and the creping surface 2. The creping apparatus further has means 13 for pivoting the bladeholder 7 and the doctor blade 5 held therein around the second rotational axis 12 to adjust the impact angle A. The pivoting means 13 include a motor 29 for precision driving of two parallel anti backlash screw jacks 13, for example, which are mounted to accomplish the pivotal movement of the bladeholder 7 and the doctor blade 5 in relation to normally fixed but pivotable portions of the creping apparatus.

According to the present invention means are provided for continually monitoring on-machine a property of the just creped off paper web 1, and the pivoting means 13 are arranged to increase the impact angle A, by pivoting the bladeholder 7 and the doctor blade 5 held therein, to such an extent as to substantially minimize or at least counteract an undesirable change in said property. The property in question is the web caliper or the web crepe macrostructure, for example, and then said monitoring means include means 80 for continually measuring a caliper of the just creped off paper web 1 and/or means 84 for continually measuring a crepe macrostructure of the just creped off paper web 1.

The caliper measuring means 80 preferably is an on-line caliper meter for soft crepe paper of the type marketed by Scandev Invent AB, Farsta, Sweden, and described by Roland Engström in Svensk Papperstidning No. 6, 1987 (in Swedish). A copy of a translation into English of the article "First in the world with on-line thickness measurement for soft tissue machines" is available from Scandev Invent AB. The meter 80 has two sensors 81 and 82 positioned on either side of the web 1. Incorporated in the upper sensor 81 and the lower sensor 82 is an adjustable measuring surface, in the middle of which a reference plate (not shown) and an inductive transducer (not shown), respectively, are mounted. The inductive transducer measures the physical distance between the lower sensor 82 and the reference plate in the upper sensor 81. Compressed air supplied to the sensors at 83 and ejected from an annular slit in the centre of each of the measuring surfaces is used for raising the measuring surfaces a predetermined fixed distance, e.g. 0.3 millimeters, from the web surface so as to permit a non-contacting measurement of the web caliper. Upon a change in the web caliper, the two sensors 81 and 82 move to maintain their predetermined distance from the web. The measured physical distance between the two sensors reduced by the two predetermined distances gives the caliper of the creped web. Thus, sensor 82 measures a value of the web caliper and emits a signal representing the measured value.

The crepe macrostructure measuring means 84 preferably is an on-line creping characteristics meter of the type marketed under the designation MCC by Techpap, Gières Mayencin, France, under license from Centre Technique de l'Industrie des Papiers, Cartons et Celluloses, see U.S. Pat. No. 4,978,861 (=WO 89/02573). The meter 84 includes a sensor 85 having a laser light source 86, a first astigmatic optical system 87 for adapting the size of the laser beam 88 to the average pitch of the crinkles or undulations formed in the web at the creping thereof, and an optoelectronic cell 89 to receive some of the back scattered laser beam. The meter 84 also includes a system (not shown) for processing the signals from the optoelectronic cell 89 to compute the wave length and, if desired, also the wave height or amplitude of the crinkles. The wave height is an approximate measure of the caliper of the creped web. As indicated by a broken line, the components of the sensor 85 may be mounted in a single housing having a window for the laser beam. Since the sensor 85 senses the difference in distance to the crests and the bottoms of the crinkles the arrangement should be such as to have the web 1 running in a fixed position past the sensor 85. For this purpose the housing may be equipped with a spacer member, not shown, having an upstream portion and a downstream portion located substantially in the plane of the window for fixing the distance to the web 1. These portions may be adapted to be in contact with the running web 1 or, alternatively, they may be tubular and provided with outlets and connected to a source of compressed air for the forming of a thin cushion of air between each of said portions and the web 1. A jet of compressed air may also be used for keeping the window clean. Thus, sensor 85 measures a value of the crepe macrostructure of the web and emits a signal representing the measured value.

Preferably, the motor 29 included in the pivoting means 13 for the adjustment of the impact angle A of the doctor blade 5 is a servomotor, and a control unit 90 is provided for controlling the servomotor 29. The control unit 90, which suitably is a programmable processor, is able to detect a change in an incoming signal and is connected to the caliper sensor 82 and the crepe macrostructure sensor 85 in a manner such that the signals emitted by the sensors constitute incoming signals. A change in the signal emitted from any one of the sensors 82 and 85 automatically causes the servomotor 29 to pivot the bladeholder 7 and thereby change the impact angle A of the doctor blade 5 so as to substantially minimize or at least counteract the measured change in the caliper or the crepe macrostructure, respectively, of the web 1. In the embodiment shown in FIG. 13 the programmable processor 90 controls the servomotor 29 by sending a pulse train to a servo drive or servo amplifier 91, which controls the flow of supply voltage from an AC line 92 to the servomotor 29 in response to a difference between the pulse train received from processor 90 and another pulse train received from the servomotor 29. The first pulse train represents the set value of the desired change of the impact angle A and the latter one represents the actual value. The servomotor 29 and the servo amplifier 91 are marketed by Sanyo Denki Co., Ltd., Tokyo, Japan, under the designation BL865 Series AC servo system.

It is also preferred that the device according to the present invention further includes means 93 for continually monitoring on-machine a creping affecting property of an adhesive coating on the movable creping surface 2. The coating is not shown in FIG. 13, but we refer to FIG. 2 in the above mentioned article in Tappi Journal, August 1991, herewith incorporated by reference. The creping affecting property monitoring means 93 include a sensor 94 for measuring a value representing the creping affecting property, and the sensor 94 emits to the programmable processor 90 a signal representing the measured value of the creping affecting property of the adhesive coating. The device further includes means 95 for adjusting the creping affecting property in response to a detected simultaneous undesirable change in the measured values of the creping affecting property and at least one of the caliper and the crepe macrostructure of the just creped off paper web 1 so as to substantially minimize or at least counteract the undesirable change in the caliper and/or the crepe macrostructure. Then, the processor 90 is programmed to keep servomotor 29 temporarily inactive so that the impact angle A will not be changed while an adjustment of the creping affecting property is taking effect. Thereby, a possible undesirable change in the creping affecting property of the adhesive coating, which wholly or partly may be the cause of the undesirable change in the caliper and/or the crepe macrostructure of the web 1, will be corrected before any remaining undesirable change in the caliper and/or the crepe macrostructure is adjusted by the pivoting of the bladeholder 7.

In the preferred embodiment shown in FIG. 13 the means 95 for adjusting the creping affecting property of the adhesive coating include a first dosing pump 96 for an adhesive agent, a second dosing pump 97 for a release agent, a control unit, which may be a separate unit but suitably is incorporated in the programmable processor 90, for controlling the dosing pumps 96 and 97, and means for applying the agents dosed by the pumps 96 and 97 onto the movable creping surface 2. More precisely, the two pumps 96 and 97 take the respective agents from a source 98 of adhesive agent and a source 99 of release agent and deliver them to a mixing tank 100, to which also water may be supplied through a pipe 101 to form the coating composition to be applied onto the movable creping surface 2. A pump 102 pressurizes the coating composition and forwards it through a filter 103 to an applying device, suitably a spraying device 104 for spraying the coating composition onto the movable creping surface 2. The mixing tank 100, the pump 102, the filter 103 and the spraying device 104 are included in the means for applying the agents dosed by the pumps onto the movable creping surface.

The processor 90 is programmed to detect a change in an incoming signal and is connected to the coating property sensor 94 and to at least one of the caliper sensor 82 and the crepe macrostructure sensor 85 in a manner such that the signal emitted from each of these sensors constitutes an incoming signal. Upon detecting an undesirable simultaneous change in the creping affecting property of the coating and in the caliper and/or the crepe macrostructure of the web 1, the programmable processor 90 controls a drive motor 105 for the adhesive agent dosing pump 96 and a drive motor 106 for the release agent dosing pump 97 to change the creping affecting property of the coating so as to substantially minimize or at least counteract the undesirable change in the caliper and/or the crepe macrostructure of the just creped off paper web 1.

Since the agents used in the coating composition are soluble in water, at least to a certain extent, a just creped off paper web having a too high moisture content will usually not be of the desired caliper and/or have the desired crepe macrostructure, because the moisture may have dissolved part of the coating and thereby caused a change in the adherence of the web to the movable creping surface. Therefore, the device according to the present invention preferably includes a moisture content sensor 107 mounted to continually monitor on-line the moisture content in the just creped off paper web 1. The moisture content sensor 107 may be connected to a separate alarm for alerting the machine operator, but in the embodiment shown in FIG. 13 it is connected to the programmable processor 90, which is programmed to suspend the operation of the creping affecting property adjusting means 95 and the bladeholder 7 pivoting means 13 until the machine operator has found and eliminated the cause of the change in moisture content. Thereby, a possible undesired change in the moisture content, which change may be caused by an error earlier in the papermaking process, will be detected and corrected before any remaining change in the creping affecting property of the coating is adjusted.

As far as we know, there is no sensor available on the market that can directly monitor the creping affecting property of the coating. However, all soft crepe paper machine operators know that there is some kind of relation between the adherence of the web to the movable creping surface and the tension in the web when it runs from the movable creping surface to a subsequent reel. The operators have been using their eyes and ears for monitoring the web tension, and when they have found that an adjustment was required, they have used their intuition acquired through the years for adjusting the coating properties. We have found that there is a direct correlation between web adherence (i.e. creping affecting property of the coating) and web tension. Thus, on measuring web tension you get a value representing also the creping affecting property of the coating. Consequently, in accordance with the present invention the sensor 94 for monitoring the creping affecting property of the coating is a web tension sensor. Conventional web tension sensors operating either with load cells mounted in roll bearings or with acoustic transmitters are not applicable for soft crepe paper grades. Therefore, the web tension sensor 94 suitably is of non-contacting type and includes a feeler, means for pressing the feeler towards the web with a constant force, means for creating a gas cushion of a predetermined thickness between the feeler and the web to prevent the feeler from contacting the web, and means for determining the position of the feeler in relation to a fixed point, said position representing the web tension. Like the caliper meter 80 the web tension sensor 94 is developed by Scandev Invent AB, and it is the subject of Swedish Patent Application No. 9100231-1, herewith incorporated by reference.

Although the method and the device in accordance with the present invention are described above in their application to the particular creping doctor apparatus disclosed in FIGS. 1 to 12, they are not restricted to such application but can be applied also on other creping doctor apparatuses having a doctor blade that is pivotable substantially around its working edge to permit an adjustment of the impact angle of the doctor blade, such as the prior art apparatus disclosed in U.S. Pat. No. 4,919,756 and referred to above. Further, in exceptional cases the amount of adhesive agent or release agent in the coating composition may temporarily be reduced to zero without departing from the spirit and scope of the invention.

What is claimed is:

1. A method of adjusting the creping conditions when creping off a paper web by means of a creping doctor from a movable creping surface to which the paper web adheres, said creping doctor having an elongate doctor blade with a working edge and mounted in a bladeholder and extending across the width of the web, said creping doctor being mounted to be pivotable on a first rotational axis parallel to the blade and located at a distance from the creping surface to permit the blade to be pivoted to an active first position for creping off the web and an inactive second position, in which a worn blade may be removed from the bladeholder and a fresh blade inserted thereinto, and said bladeholder and blade being mounted to be pivotable around a second rotational axis parallel to the blade working edge and located for setting a desired impact angle formed at the blade edge between the creping surface and an impact surface of the blade edge, said method comprising directing the paper web just after being creped off from the creping surface past a sensor and measuring a physical property of the web, generating a signal from the sensor representing the measured value of said property, monitoring the signal emitted from the sensor, and in response to a predetermined change in the signal which is indicative of an undesirable change in said property caused by blade wear, pivoting the bladeholder and the doctor blade around the second rotational axis to compensate for wear of the impact surface of the blade edge and maintain the impact angle to such an extent as to minimize or counteract the detected undesired change in said property, providing a second sensor for measuring on-machine a value representing a creping affecting property of an adhesive coating on the movable creping surface, said second sensor emitting a signal representing the measured value of said creping affecting property of the adhesive coating, continually monitoring the signals emitted from said first and second sensors, and, on detecting a simultaneous undesirable change both in the creping affecting property of the adhesive coating and in the monitored property of the just creped off paper web, adjusting the creping affecting property to such an extent as to minimize or counteract the undesirable change in the monitored property of the just creped off paper web, and carrying out the adjusting of the creping affecting property prior to commencing the pivoting of the bladeholder and the doctor blade held therein.

2. A method as claimed in claim 1, comprising adjusting said creping affecting property by changing the amounts of ingredients in a coating composition to be applied to the movable creping surface to form the adhesive coating, said coating composition containing an adhesive agent, a release agent, and water.

3. A method as claimed in claim 2, comprising providing a first dosing pump for the adhesive agent, a second dosing pump for the release agent, and a control unit for controlling the dosing pumps, said control unit being able to detect a change in incoming signals, and feeding the signals emitted from the first and second sensors as incoming signals to the control unit, whereby said control unit on detecting simultaneous undesirable changes in the creping affecting property of the coating and in said monitored property of the just creped off paper web automatically controls the dosing pumps to change the creping affecting property of the coating so as to minimize or counteract the measured change in said monitored property of the just creped off paper web.

4. A method as claimed in claim 1, comprising continually monitoring a moisture content in the just creped off paper web, the moisture in the web influencing the creping affecting property of the coating, and, on detecting an undesirable change in said moisture content, finding and eliminating the cause of the change in the moisture content prior to adjusting the creping affecting property.

5. A method as claimed in claim 1, wherein the second sensor is a sensor for measuring a tension in the just creped off paper web, said web tension correlating with the creping affecting property of the coating.

6. A device for adjusting the creping conditions when creping off a paper web by means of a creping doctor from a movable creping surface to which the paper web adheres, said creping doctor having an elongate doctor blade with a working edge and mounted in a bladeholder and extending across the width of the web, said creping doctor being mounted to be pivotable on a first rotational axis parallel to the blade and located at a distance from the creping surface to permit the blade to be pivoted to an active first position for creping off the web and an inactive second position, in which a worn blade may be removed from the bladeholder and a fresh blade inserted thereinto, and said bladeholder and blade being mounted to be pivotable around a second rotational axis parallel to the blade working edge and located for setting a desired impact angle formed at the blade edge between the creping surface and an impact surface of the blade edge, said device comprising means for continually monitoring on-machine a property of the just creped off paper web, means responsive to said monitoring means for pivoting the bladeholder and the doctor blade held therein around the second rotational axis to compensate for wear of the impact surface of the blade edge and maintain the impact angle to such an extent as to minimize or counteract an undesirable change in said property, and means for continually monitoring on-machine a creping affecting property of an adhesive coating on the movable creping surface, said creping affecting property monitoring means including a second sensor for measuring a value representing the creping affecting property, said second sensor emitting a signal representing the measured value of the creping affecting property of the adhesive coating, said device further including means for adjusting the creping affecting property of the adhesive coating on the movable creping surface in response to a detected simultaneous undesirable change in the measured values of the creping affecting property and the monitored property of the just creped off paper web so as to minimize or counteract the undesirable change in the monitored property of the just creped off paper web, said pivoting means being arranged to be inactive while an adjustment of the creping affecting property is taking effect.

7. A device as claimed in claim 6, wherein the means for adjusting the creping affecting property of the adhesive coating include a first dosing pump for an adhesive agent, a second dosing pump for a release agent, a control unit for controlling the dosing pumps, and means for applying the agents dosed by the pumps onto the movable creping surface, said control unit being able to detect a change in an incoming signal and being connected to the first sensor and the second sensor in manner such that the signal emitted from each of the sensors constitutes an incoming signal, said control unit upon detecting a simultaneous undesirable change in the measured values of the creping affecting property and the monitored property of the just creped off paper web controlling the dosing pumps to change the creping affecting property of the adhesive coating so as to minimize or counteract the undesirable change in said monitored property of the just creped off paper web.

8. A device as claimed in claim 7, wherein the second sensor is a web tension sensor, the web tension correlating with the creping affecting property of the coating.

9. A device as claimed in claim 8, wherein the web tension sensor is of non-contacting type and includes a feeler, means for pressing the feeler towards the web with a constant pressure, means for creating a gas cushion of a predetermined thickness between the feeler and the web to prevent the feeler from contacting the web, and means for determining the position of the feeler in relation to a fixed point, said position representing the web tension.

10. A device as claimed in claim 6, wherein the device further includes a moisture content sensor mounted to continually monitor on-line a moisture content in the just creped off paper web.

* * * * *